US006327786B1

(12) United States Patent
Felix

(10) Patent No.: US 6,327,786 B1
(45) Date of Patent: Dec. 11, 2001

(54) CARPENTERS SQUARE WITH ELEVATION ATTACHMENT

(76) Inventor: John E. Felix, 2216 Kendree St., Antioch, CA (US) 94509

( * ) Notice: Subject to any disclaimer, the term of this patent is extended or adjusted under 35 U.S.C. 154(b) by 0 days.

(21) Appl. No.: 09/283,354

(22) Filed: Mar. 31, 1999

(51) Int. Cl.[7] ..... B43L 7/00
(52) U.S. Cl. ..... 33/474
(58) Field of Search ..... 33/404, 405, 411, 33/429, 474, 476, 480, 481, 406–410, 475, 484, 485, 489, 518, 535, 413, 414, 756

(56) References Cited

U.S. PATENT DOCUMENTS

| | | | | |
|---|---|---|---|---|
| D. 260,616 | | 9/1981 | Groves | D10/65 |
| D. 314,712 | | 2/1991 | Kunz | D10/61 |
| 1,336,004 | * | 4/1920 | Victoria | 33/404 |
| 2,664,636 | * | 1/1954 | Schneider et al. | 33/406 |
| 3,101,184 | * | 8/1963 | Allen et al. | 33/404 |
| 3,492,737 | | 2/1970 | Swanson | 33/809 |
| 4,194,295 | | 3/1980 | Simuro et al. | 33/458 |
| 4,443,954 | * | 4/1984 | Clark | 33/404 |
| 4,573,276 | * | 3/1986 | Torczon | 33/481 |
| 4,641,435 | * | 2/1987 | Brown | 33/427 |
| 4,656,753 | * | 4/1987 | Chesworth | 33/408 |
| 4,729,173 | | 3/1988 | Wilson | 33/451 |
| 4,924,579 | * | 5/1990 | Berendsen | 33/404 |
| 5,129,150 | * | 7/1992 | Sorensen | 33/408 |
| 5,269,066 | | 12/1993 | Walters | 33/451 |
| 5,542,187 | * | 8/1996 | Oakley | 33/404 |
| 5,657,548 | * | 8/1997 | Kellar, Sr. | 33/405 |
| 5,771,597 | * | 6/1998 | Hopf | 33/474 |
| 5,778,546 | * | 7/1998 | Williamson | 33/405 |
| 5,778,547 | * | 7/1998 | Wolken | 33/427 |
| 5,855,073 | * | 1/1999 | Boelling | 33/474 |
| 5,897,816 | * | 4/1999 | Johnson | 33/404 |
| 6,161,297 | * | 12/2000 | Boggs | 33/529 |

* cited by examiner

*Primary Examiner*—Christopher W. Fulton
*Assistant Examiner*—Gail Verbitsky
(74) *Attorney, Agent, or Firm*—Gene Scott-Patent Law & Venture Group

(57) ABSTRACT

A carpenter' square provides a pair of I-shaped legs joined at right angles, each of the legs having a pair of back-to-back U-shaped channels preferably of a size for accepting a construction material, such as common 2×4, 2×6 and 2×8 lumber boards. The lumber may be inserted snugly into them so as to align the lumber at right angles. The square also may include a gusset plate for mounting the square onto a construction stake at any selected height and direction so as to enable the defining of a corner and its related orthogonal directions.

4 Claims, 2 Drawing Sheets

CARPENTERS SQUARE WITH ELEVATION ATTACHMENT

BACKGROUND OF THE INVENTION

1. Field of the Invention

This invention relates generally to right angle measurement in construction and, and more particularly to a carpenter's square with features for alignment of boards and for defining a pair of orthogonal directions and a related corner.

2. Description of Related Art

The following art defines the present state of this field:

Swanson, U.S. Pat. No. 3,492,737 describes an extensible rule having a plurality of telescopically engaged channel sections. The rule is provided with quickly detachable attachments for extending the range of its functional capabilities. The sections, except the outermost section, are frictionally slidable within each other nested in telescoping relationship. Each section had a flat web and side walls lying in planes normal to that of the web. Shallow recesses are formed in the outer surfaces and graduated strips are positioned in the recesses. The outermost section is a rectangular tube with a closed rear wall for enclosing the other inner sections when the other sections are completely retracted within the outermost section.

Simuro et al., U.S. Pat. No. 4,194,295 describes an attachment for a carpenter's folding ruler that has an elongated body with a longitudinal slot. The slot is dimensioned to accept the ruler and the ends of the body have flat sections against which part of the ruler can be folded to form certain angles. One of the ends makes a 90° angle with the axis of the slot while the other ends is at some angle less than 90°. A level is provided on the body so that it may be vertically or horizontally positioned.

Wilson, U.S. Pat. No. 4,729,173 describes an adjustable carpenter's square that is formed by having a main beam with a head secured to an upper portion of the main beam with a slide secured to the upper end of the main beam. The head and the slide are partially rotatably secured to the main beam. The head and the slide are slideably and adjustably connected to each other also in addition to being connected to the head.

Walters, U.S. Pat. No. 5,269,066 describes an improved hand tool comprising a generally L-shaped frame having two legs each formed with a pair of channels spaced apart by a central ridge, and having panels of transparent material, such as tempered glass or plastic, mounted in the channels with a quantity of a suitable liquid contained between the panels to define a level-indicating chamber extending substantially the entire length of each leg and having indicia positioned adjacent the ends of each of these chambers to provide information relating to incremental discrepancies.

Kunz, U.S. D314,712 describes the ornamental design for a T-square with centering ruler.

Groves, U.S. D260,616 describes the ornamental design for an adjustable carpenter's square.

The prior art teaches a variety of tools capable of enabling the alignment of boards and other construction materials at a right angle as for defining a corner of a construction. The prior art also teaches the use of construction stakes for defining a corner of a construction. However, the prior art does not teach a carpenter's square having a conformation and shape capable of easily aligning common boards by the use of U-shaped channels. The prior art also does not teach the use of such a square for defining a right angle in a construction line. The present invention fulfills these needs and provides further related advantages as described in the following summary.

SUMMARY OF THE INVENTION

The present invention teaches certain benefits in construction and use which give rise to the objectives described below.

The present invention is a carpenter' square which provides a pair of I-shaped legs joined at right angles, each of the legs having a pair of back-to-back U-shaped channels preferably of a size for accepting a construction material, such as common 2×4, 2×6 and 2×8 lumber boards. The lumber may be inserted snugly into them so as to align the lumber at right angles. The square also may include a gusset plate for mounting the square onto a construction stake so as to enable the alignment of construction lines at a right angle corner.

A primary objective of the present invention is to provide a carpenter's square having advantages not taught by the prior art.

Another objective is to provide such a carpenter's square that is able engage common lumber boards for right angle alignment of the boards.

A further objective is to provide such a carpenter's square that is able to engage construction lines while being mounted onto a construction stake so as to define a corner and a pair of orthogonal directions related to the corner.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
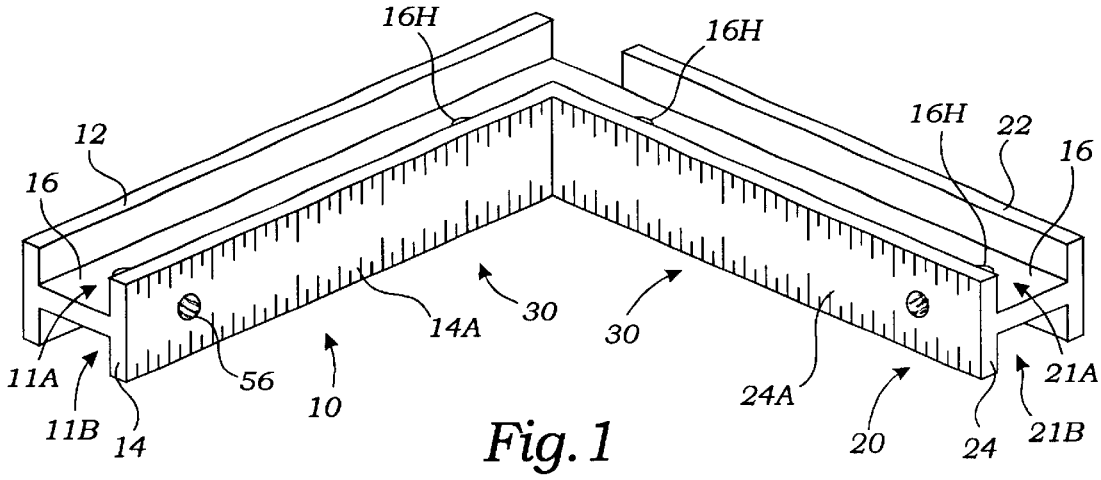
FIG. 1 is a perspective view of the preferred embodiment of the present invention shown from a first inside vantage point.

The above described drawing figures illustrate the invention, a carpenter's square device made of a rigid material such as plastic or metal, comprising a pair of I-shaped legs 10 and 20, joined at right angles, each of the legs having an outer plate 12, 22 and an inner plate 14, 24 joined in parallel and spaced apart juxtaposition, by a center plate 16; each of the outer plates providing an outwardly facing surface 12A and 22A respectively (FIG. 2) having a ruled indicia 30 for measuring length along its surface, each of the inner plates 14, 24 providing an inwardly facing surface 14A and 24A respectively having the ruled indicia 30 for measuring length along its surface, the outwardly facing surfaces 12A and 22A forming a right angle; and the inwardly facing surfaces 14A and 24A forming a right angle as well.

The center plate 16 of the I-shaped legs 10, 20 provides an aperture means 16H, preferably a series of through holes, providing clearance for a means for fastening such as a screw 16S or nail (FIG. 3), such that the device may be attached to a construction surface 40S, such as the surface of a plank or board 40.

Figure 2:
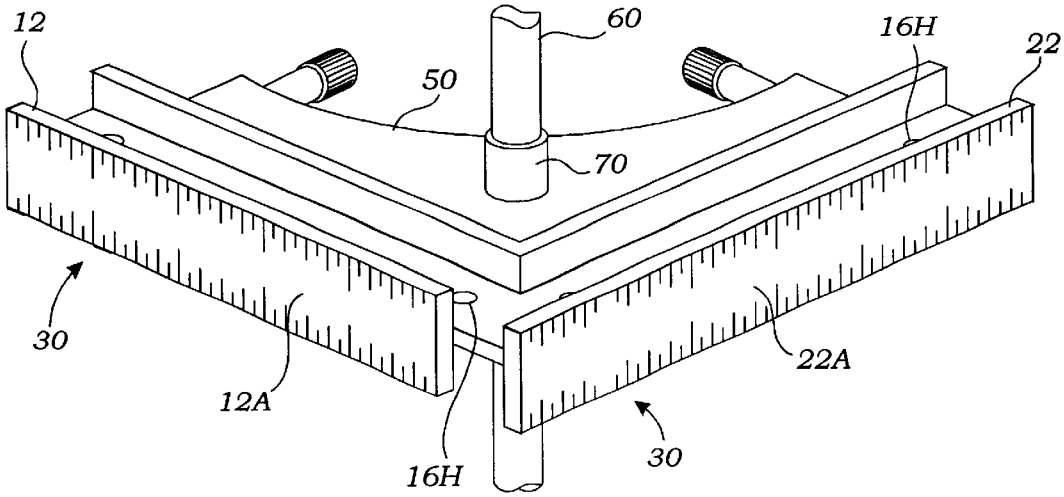
FIG. 2 is a perspective view of the preferred embodiment of the present invention shown from a second, outside vantage point and further showing a construction stake mounting accessory useful for defining corners of a construction.
Figure 3:
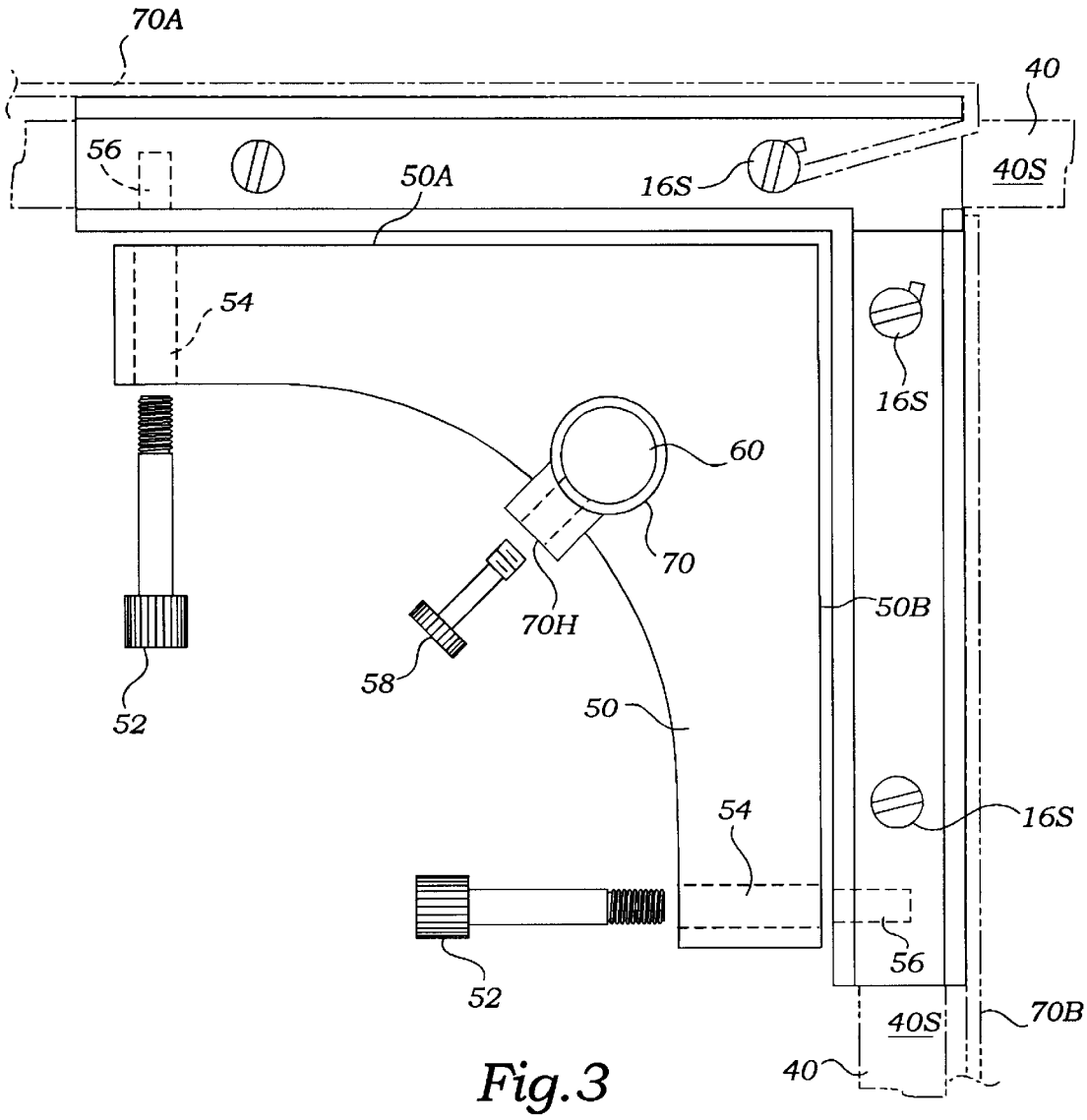
FIG. 3 is an exploded top plan view thereof illustrating a preferred manner of assembly, the use of construction line alignment with a selected corner, and the use of the device with lumber for right angle alignment.

A gusset plate 50, as best seen in FIG. 2, may be attached to the carpenter's square such that a pair of edges 50A, 50B (FIG. 3) of the gusset plate 50 abut the inwardly facing surfaces 14A, 24A of the I-shaped legs. The gusset plate 50 is best constructed by including a means for removably attaching 52 the gusset plate 50 to the I-shaped legs 10, 20 such as the bolts shown in FIG. 3. The bolts 52 are inserted into clearance holes 54 and engage threaded holes 56 in the carpenter's square. Therefore, it is a best mode teaching that the gusset plate 50 may be removed or replaced, so that a variety of custom gusset plates of similar construction, may be employed with the carpenter's square for a variety of applications such as mounting the square to constructions when linear measurement or a right angle must be determined. Preferably, a means for attaching 58 the gusset plate 50 to a vertically oriented construction stake 60 is provided, so as to position the I-shaped legs 10, 20 laterally with respect to the construction stake 60. Preferably, the means for attaching 58 includes a collar 70 having a threaded hole 70H therein. The collar 70 is preferably fixed to the gusset plate 50 so as to provide a more stable attachment of the invention to the stake 60. Obviously, the device may be set onto the stake 60 at any desired vertical position by merely moving the device to such position prior to setting the set screw (attaching means 58). The device may also be positioned at any desired horizontal position by merely rotating the device about the stake 60 prior to tightening the set screw onto the stake. Construction lines 70A and 70B may be attached or anchored to the device as shown in FIG. 3 so that the lines define a pair of orthogonal directions and a corner.

Each of the corresponding outer 12, 22 inner 14, 24 and center 16 plates form a pair of back-to-back U-shaped channels 11A, 11B and 21A, 21B as best seen at the extremities of the device in FIG. 1. Each one of the channels is preferably of a size for accepting a construction material, such as the board 40, having a standardized size. Common examples are 2×4, 2×6 and 2×8 lumber boards where the numbers are expressed in inches and commonly the 2 inch dimension is approximately 1⅝ inches. Common also are 4×4 beams as well as other sizes. The U-shaped channels 11A,B and 21A,B are preferably sized so that 2-by and 4-by lumber may be inserted snugly into them. In this manner the device and the board are automatically aligned in a common direction allowing another similar board to be inserted into the adjacent perpendicular channel in the device to align the boards 40 at a right angle, thereby forming a corner or a tee, the later being shown in FIG. 3. Such corners and tees are utilized in building construction as well as furniture and other constructions.

The invention therefore teaches a method of squaring a pair of construction boards 40 comprising the steps of:

a) providing a carpenter's square device having a pair of U-shaped channels 11B 21B arranged to form a right angle between them;

b) mounting the device onto a first of the pair of construction boards 40 by securing the first of the boards into one 11B of the U-shaped channels, as shown in FIG. 3; and c) securing the second of the boards 40 in a position abutting the first of the boards and in another 21B of the U-shaped channels.

The invention also teaches a method of setting a pair of construction lines 70A and 70B to form a right angle between them comprising the steps of:

a) providing a carpenter's square device having a pair of surfaces 12A and 22A forming a right angle between them and a means for mounting 50 the device onto a construction stake 60;

b) mounting the carpenter's square onto the construction stake 60 so as to align the pair of surfaces 12A and 22A with a selected corner of a construction plan, c) setting one of the pair of construction lines 70A so as to run along one of the pair of surfaces 12A and 22A of the carpenter's square; and d) setting the other of the pair of construction lines 70B so as to run along the other of the pair of surfaces 12A and 22A of the carpenter's square.

In the above method, the construction lines are shown terminated under screws 16S, but alternately, the lines may be part of a single continuous line whereby one of the screws 16S forms an anchor for the lines.

While the invention has been described with reference to at least one preferred embodiment it is to be clearly understood by those skilled in the art that the invention is not limited thereto. Rather, the scope of the invention is to be interpreted only in conjunction with the appended claims.

What is claimed is:

1. A carpenter's square device comprising:

a pair of rigid legs joined at right angles;

and forming a pair of orthogonal inwardly facing surfaces; and a gusset plate removably engaged with and abutting the inwardly facing surfaces of the legs, the gusset plate providing an attachment means engaging a construction stake such that the legs are positioned laterally with respect to the construction stake.

2. The device of claim 1 further comprising a means for removeably attaching the gusset plate to the legs.

3. The device of claim 1 further including a means for fixing the device at a selected rotational position about the construction stake.

4. A method of squaring a pair of construction boards comprising the steps of:

a) providing a carpenter's square device having a pair of U-shaped channels arranged to form a right angle therebetween;

b) mounting the device onto a first of the pair of construction boards by securing the first of the boards into one of the U-shaped channels; and c) securing the second of the boards in a position abutting the first of the boards and in another of the U-shaped channels.

* * * * *